US009205344B2

(12) United States Patent
Botterill et al.

(10) Patent No.: US 9,205,344 B2
(45) Date of Patent: Dec. 8, 2015

(54) TOY FIGURE ASSEMBLY

(71) Applicant: Hasbro, Inc., Pawtucket, RI (US)

(72) Inventors: Harry Alexander Botterill, London (GB); Brian E. Fontaine, Southbridge, MA (US); Salvatore F. Lama, Bolton, MA (US)

(73) Assignee: Hasbro, Inc., Pawtucket, RI (US)

( * ) Notice: Subject to any disclaimer, the term of this patent is extended or adjusted under 35 U.S.C. 154(b) by 171 days.

(21) Appl. No.: 13/762,469

(22) Filed: Feb. 8, 2013

(65) Prior Publication Data

US 2014/0227936 A1 Aug. 14, 2014

(51) Int. Cl.

| | |
|---|---|
| ***A63H 3/00*** | (2006.01) |
| ***A63H 33/04*** | (2006.01) |
| ***A63H 33/06*** | (2006.01) |
| ***A63H 3/16*** | (2006.01) |

(52) U.S. Cl.
CPC ..... *A63H 33/04* (2013.01); *A63H 3/16* (2013.01); *A63H 33/062* (2013.01)

(58) Field of Classification Search
CPC ..... A63H 33/086; A63H 33/04
USPC ..... 446/128, 97
See application file for complete search history.

(56) References Cited

U.S. PATENT DOCUMENTS

| | | | | |
|---|---|---|---|---|
| 1,868,049 | A * | 7/1932 | Deichmann | 446/100 |
| 2,106,148 | A | 1/1938 | Kellner | |
| 2,663,971 | A | 12/1953 | Ippolito | |
| 2,752,726 | A | 7/1956 | Calverley | |
| 2,884,739 | A | 5/1959 | Ketcham | |
| D210,471 | S | 3/1968 | Ach | |
| 3,768,197 | A | 10/1973 | Shimamura | |
| 3,874,113 | A | 4/1975 | Beck | |
| 3,946,517 | A | 3/1976 | Goldfarb et al. | |
| 3,988,855 | A | 11/1976 | Crabtree et al. | |
| 3,995,395 | A | 12/1976 | Rahmstorf | |
| 4,028,844 | A | 6/1977 | Dideriksen et al. | |
| 4,063,381 | A | 12/1977 | Deulofeu | |
| D248,881 | S | 8/1978 | Goldfarb et al. | |
| 4,103,451 | A | 8/1978 | Kawada et al. | |

(Continued)

FOREIGN PATENT DOCUMENTS

| | | |
|---|---|---|
| CA | 143573 | 7/2012 |
| CA | 143574 | 7/2012 |

(Continued)

OTHER PUBLICATIONS

"Minifigure"—Brickipedia: https://web.archive.org/web/20090209135214/http://lego.wikia.com/wiki/Minifigure, Feb. 9, 2009.*

(Continued)

*Primary Examiner* — Michael Dennis
*Assistant Examiner* — Urszula M Cegielnik
(74) *Attorney, Agent, or Firm* — DiBerardino McGovern IP Group LLC

(57) ABSTRACT

A toy figure assembly can be interconnected to construct a toy figure. The mating parts of the toy figure assembly are structured for friction fit attachment and include an upper body part including a neck portion and a trunk portion; a lower body part including a rod portion, a stud portion, a legs portion, and a feet portion; and arm parts having a hand portion, a forearm portion, an elbow portion, an upper arm portion, and a shoulder portion.

18 Claims, 7 Drawing Sheets

(56) References Cited

U.S. PATENT DOCUMENTS

| | | | | |
|---|---|---|---|---|
| 4,136,481 | A | 1/1979 | Nicholls | |
| D253,711 | S | 12/1979 | Christiansen et al. | |
| 4,190,982 | A | 3/1980 | Rahmstorf | |
| 4,203,248 | A | 5/1980 | Tapdrup | |
| 4,205,482 | A | 6/1980 | Christiansen et al. | |
| 4,519,786 | A | 5/1985 | Larws | |
| 4,643,691 | A | 2/1987 | Keiji | |
| 4,988,324 | A | 1/1991 | Ryaa et al. | |
| 5,087,219 | A | 2/1992 | Price | |
| D352,078 | S | 11/1994 | Bertrand | |
| 5,380,233 | A * | 1/1995 | Numoto | 446/92 |
| 5,518,434 | A | 5/1996 | Ziegler | |
| 5,913,706 | A * | 6/1999 | Glickman et al. | 446/97 |
| D474,614 | S | 5/2003 | Schwartz | |
| 6,648,715 | B2 * | 11/2003 | Wiens et al. | 446/121 |
| 6,893,318 | B2 * | 5/2005 | Søviknes et al. | 446/379 |
| D539,364 | S | 3/2007 | Sofussen | |
| D581,994 | S | 12/2008 | Wilk et al. | |
| 7,553,209 | B1 | 6/2009 | Sorensen | |
| D611,108 | S | 3/2010 | Bodin | |
| D638,084 | S | 5/2011 | Barbis | |
| 8,210,891 | B2 | 7/2012 | Brumagin et al. | |

FOREIGN PATENT DOCUMENTS

| | | | |
|---|---|---|---|
| DE | 7039572 | | 1/1971 |
| EP | 1099460 | A2 * | 5/2001 |
| FR | 2318663 | | 2/1977 |

OTHER PUBLICATIONS

The International Search Report and Written Opinion issued by Josef Ullrich of the European Patent Office in Counterpart patent application, PCT/2014/014685 (Publication WO 2014/123911) on Aug. 1, 2014, 12 pages.

Communication relating to the results of the Partial International Search in Counterpart application, PCT/2014/014685, May 9, 2014, 5 pages.

"The History and Evolution of the Lego Minifigure," by Toys 2 Remember, captured on Dec. 18, 2010 at http://web.archive.org/web/20101218060740/http://www.toys2remember.com/2010/11/lego-minifigure-history.html, 8 pages.

Wikipedia article on "Lego minifigure," captured on Dec. 9, 2011 at http://web.archive.org/web/20111209210840/http://en.wikipedia.org/wiki/Minifigure, 5 pages.

Cube Figured by Magnote, captured on Jan. 25, 2012 at http://web.archive.org/web/20120125002644/http://www.magnote.com/gigoblocks/cubefigures/, 3 pages.

Review—Transformers Kreons published by Philip Reed on Aug. 20, 2011 at http://www.battlegrip.com/?p=31043, 10 pages.

International Preliminary Report on Patentability, equivalent International Patent Application No. PCT/US2014/014685, mailed Aug. 20, 2015, 12 pages.

* cited by examiner

TOY FIGURE ASSEMBLY

TECHNICAL FIELD

This disclosure relates to an assembly of parts that can be interconnected to construct a toy figure.

BACKGROUND

Construction toys that include interlocking plastic building elements promote creative and imaginative play by end users. Typically, plastic building elements attach to each other or interlock using an array of small cylindrical bumps or "studs" on the top surface of one building element that fit into an array of holes or recesses on the bottom surface of another building element. In general, the size and spacing of the studs and holes are standardized to enable attachment among various types of building elements and accessories that can be included in one or more construction toy kits.

A construction toy kit can include a standard set of pieces for allowing end users to design and build a variety of different models. A construction toy kit also can provide instructions for using certain pieces to build a particular model. In some cases, construction toy kits can be associated with particular themes for building models representing historical, contemporary, futuristic, or fictional structures.

In addition to building elements, construction toy kits often include small plastic toy figures to enhance play. Typically, the toy figures are about 1.5 inches tall and include head, arms, hands, torso, hips, and legs parts. The toy figures may represent characters associated with a particular theme and generally are structured to connect to the building elements and carry accessories such as small plastic tools.

SUMMARY

Various implementations are directed to mating parts of a toy figure assembly, which can be interconnected to construct a toy figure. The mating parts of the toy figure assembly are structured for friction fit attachment and may include an upper body part including a neck portion and a trunk portion; a lower body part including a rod portion, a stud portion, a legs portion, and a feet portion; and arm parts having a hand portion, a forearm portion, an elbow portion, an upper arm portion, and a shoulder (or deltoid) portion.

In some general aspects, a toy figure assembly includes an upper body part defining a side bore and at least two interior bearing surfaces; an arm part; and a lower body part attached to the upper body part. The arm part includes a non-shoulder portion, and a shoulder portion adjacent the non-shoulder portion and having an outer diameter greater than an outer diameter of the non-shoulder portion, the shoulder portion having at least two shoulder bearing surfaces and an axial relief slot that extends toward the non-shoulder portion. At least one of the upper body part and the lower body part includes a recess for frictionally engaging a stud of a toy building element. When the arm part is snap fit through the bore of the upper body part, the at least two shoulder bearing surfaces of the shoulder portion abut the at least two interior bearing surfaces of the upper body part, respectively.

Implementations can include one or more of the following features. For example, the at least two shoulder bearing surfaces can be seated between the at least two interior bearing surfaces of the upper body part after the arm part is snap fit through the bore of the upper body part. The upper body part can include a neck portion and a trunk portion, the neck portion projecting from a top surface of the trunk portion and having an inner surface defining a through hole that opens into the trunk portion. A first of the interior bearing surfaces of the upper body part can extend from a neck portion into a trunk portion that defines the side bore, the first of the interior bearing surfaces facing the bore; and a second of the interior bearing surfaces of the upper body part can be a flat inside surface of the trunk portion that defines the side bore, the second of the interior bearing surfaces facing the first of the interior bearing surfaces. The trunk portion can include a front wall, a rear wall, and a side wall connecting the front and rear walls, one of the walls defining the side bore and the flat inside surface.

The toy figure assembly can include a plurality of arm parts, each arm part being identical to each other.

The arm part can include an axial relief slot that splits the shoulder portion and a section of the non-shoulder portion. The upper body part can attach to the arm part by receiving the entire shoulder portion and at least the section of the non-shoulder portion that includes the relief slot into a trunk portion of the upper body part. Each shoulder portion can include two bottom faces perpendicular to the periphery of the shoulder portion, the bottom faces define shoulder bearing surfaces for contacting corresponding interior bearing surfaces defined by interior sidewalls within the upper body part. Each shoulder portion can include two top faces perpendicular to the periphery of the shoulder portion, the top faces define shoulder bearing surfaces for contacting corresponding interior bearing surfaces defined by a flat inside surface of the upper body part.

The non-shoulder portion of each arm part includes a hand portion, a forearm portion, an elbow portion, and an upper arm portion adjacent the shoulder portion. A center-to-center distance between each hand portion can correspond to a center-to-center distance between studs of a building element. Each forearm portion, elbow portion, and upper arm portion of one of the arm parts can have a standard diameter capable of being held by a hand portion of a different one of the arm parts.

In other general aspects, a toy figure assembly includes an upper body part including a neck portion and a trunk portion, the neck portion projecting from a top surface of the trunk portion and having an inner surface defining a through hole that opens into the trunk portion. The trunk portion includes a front wall, a rear wall, a side wall defining a side bore and having a flat inside surface. An inner surface of the front wall and an inner surface of the rear wall each include an upper longitudinal flat, interior sidewalls which abut the upper longitudinal flat, and a lower longitudinal flat. The toy figure assembly also includes a lower body part structured for friction fit attachment to the upper body part, the lower body part including a rod portion, a stud portion, a legs portion, and a feet portion. Each upper longitudinal flat is structured to cooperate with the interior sidewalls that abut the upper longitudinal flat to define a track for engaging the rod portion when received into the trunk portion. Each lower longitudinal flat is structured to cooperate with the flat inside surface of the side wall for engaging the stud portion when received into the trunk portion.

Implementations can include one or more of the following features. For example, a bottom surface of each upper longitudinal flat and bottom surfaces of the interior sidewalls that abut the upper longitudinal flat can provide stops for contacting a top surface of the stud portion when received into the trunk portion.

Each interior sidewall that abuts the upper longitudinal flat can be visible through the side bore. Each upper longitudinal flat can further extend longitudinally along the inner surface of the neck portion.

The track can communicate with the through hole. The interior sidewalls that abut the upper longitudinal flat can define bearing surfaces for contacting arm parts to be received into the trunk portion.

In other general aspects, a toy construction set includes a toy figure assembly having a head part, an upper body part removably attachable to the head part via a non-snap frictional engagement, and a lower body part removably attachable to the upper body part via a non-snap frictional engagement. The lower body part includes a single recess structured for non-snap frictional attachment to a building element via only a single stud on the building element.

Implementations can include one or more of the following features. The toy construction set can also include a building element that defines a coupling stud. When the coupling stud is frictionally received in a recess defined by the lower body part, the toy figure can be attached to the building element via a non-snap frictional engagement, and all of the elements of the toy figure can be removed from the building element and retain non-snap frictional engagement when the toy figure is pulled only by the head part.

A hierarchy of interference forces can be in effect when a toy figure is assembled from the head part, the upper body part, and the lower body part and the lower body part is attached to the single stud of the building element, the hierarchy of interference forces including a greatest interference force between the head part and the upper body part and a weakest interference force between the lower body part and the stud on the building element, and wherein the hierarchy of interference forces allows the toy figure to be removed from the building element as a single unit when the toy figure is pulled only by the head part.

The upper body part can include a neck portion and a trunk portion, the neck portion projecting from a top surface of the trunk portion and having an inner surface defining a through hole that opens into the trunk portion.

The interference force between the lower body part and the stud on the building element can correspond to an interference force between building elements.

The toy construction set can also include arm parts structured for snap fit attachment to the upper body part, wherein connection between the upper body part and the arm parts is tight enough so that each of the arms parts can maintain any angular position and is loose enough so that each of the arm parts can be repositioned without overcoming the interference force between the lower body part and the stud on the building element.

In another general aspect, a toy construction set includes one or more building elements having coupling elements of a first coupling size; one or more accessory building elements having coupling elements of a second coupling size that is distinct from the first coupling size; and one or more toy figure assemblies. Each toy figure assembly includes a plurality of interconnectable body parts including an upper torso body part and a lower legs and feet body part, and at least two of the interconnectable body parts includes a coupling system to which coupling elements of the first coupling size and coupling elements of the second coupling size of the building elements of the set can be frictionally attached.

In other general aspects, a toy figure assembly includes an upper body part; a head part structured for friction fit attachment to the upper body part; and a lower body part structured for friction fit attachment to the upper body part and structured for attachment to a building element via only a single stud on the building element. A hierarchy of interference forces is in effect when a toy figure is assembled from the head part, the upper body part, and the lower body part and the lower body part is attached to the single stud of the building element, the hierarchy of interference forces including a greatest interference force between the head part and the upper body part and a weakest interference force between the lower body part and the stud on the building element, and wherein the hierarchy of interference forces allows the toy figure to be removed from the building element as a single unit when the toy figure is pulled only by the head part.

BRIEF DESCRIPTION OF THE DRAWINGS

The foregoing aspects and many of the attendant advantages of various implementations will become more readily appreciated and better understood by reference to the following detailed description and the accompanying drawings.

DETAILED DESCRIPTION

Various implementations are directed to parts of an assembly that can be interconnected to construct a toy figure. Numerous specific details are set forth; however, the implementations can be practiced without these specific details. Specific structural and functional details disclosed herein are representative and do not necessarily limit the scope of the implementations.

Figure 2:
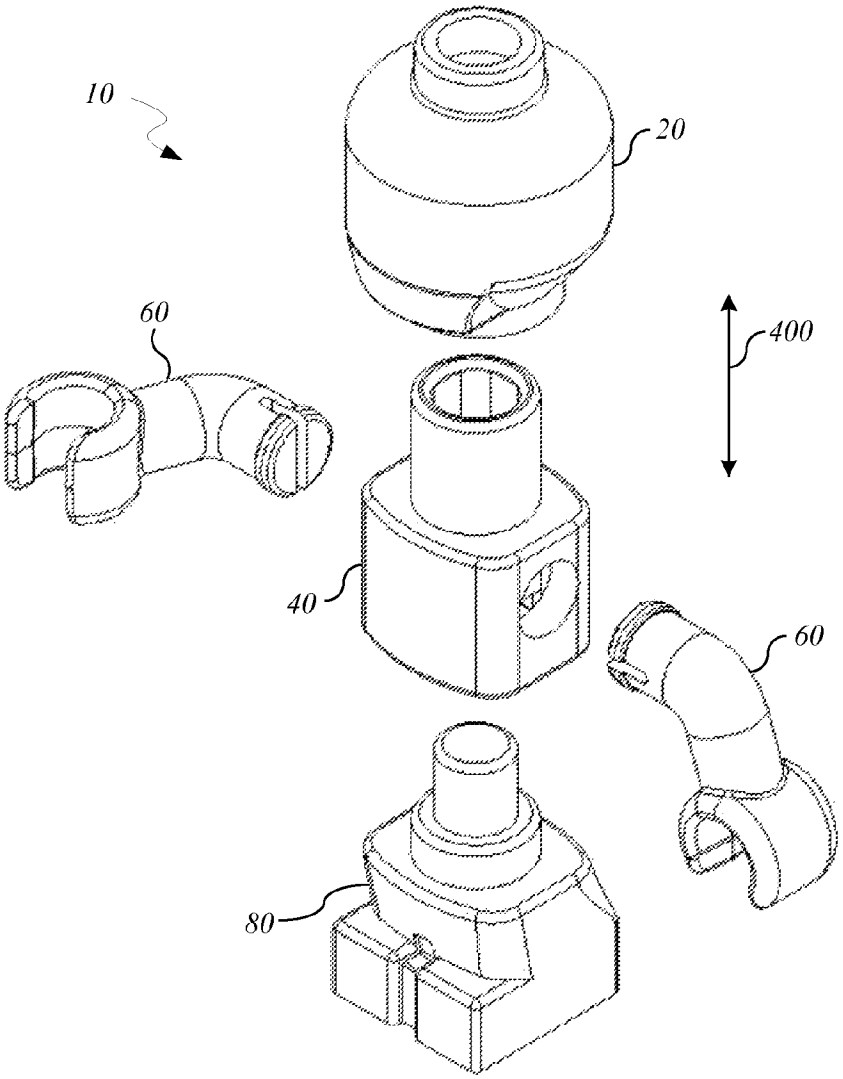
FIG. 2 is an exploded perspective view of an assembly for the toy figure of FIG. 1.
Figure 1:
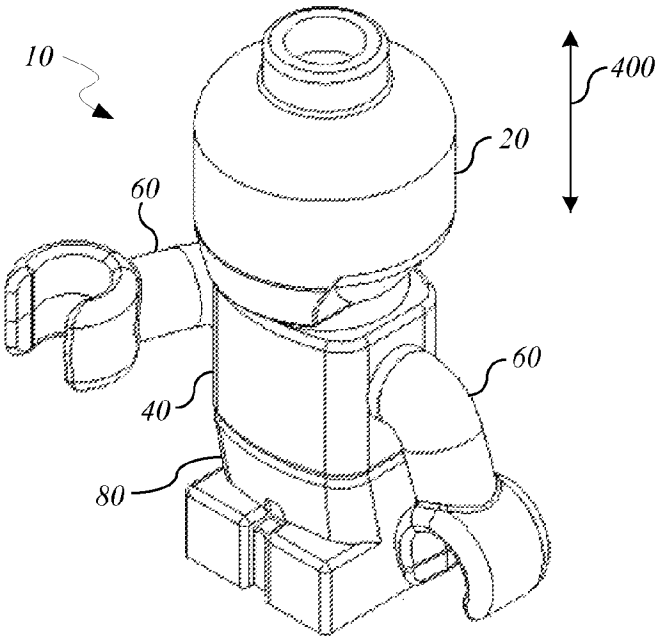
FIG. 1 is a perspective view of an exemplary toy figure.

FIGS. 1 and 2 illustrate an exemplary toy FIG. 10 and its assembly. As shown, the toy FIG. 10 includes a head part 20, an upper body part 40, arm parts 60, and a lower body part 80. The parts of the toy FIG. 10 can be formed from plastic such as acrylonitrile butadiene styrene (ABS) or any other suitable material. While not shown, the parts of the toy FIG. 10 can be decorated in various ways (for example, with paint or stickers or etchings) to represent a character associated with a particular theme. In general, the toy FIG. 10 is a part of a toy construction kit, which includes standard building elements, each building element including one or more coupling elements. Coupling elements of the standard building elements can be male and in the form of a coupling stud, or can be female and in the form of a coupling recess that is sized to receive the coupling stud. The male and female coupling elements can have a first coupling size. For example, the first coupling size of a standard coupling stud (that is on the surface of a building element) is defined by a diameter of 4.88 mm and a height of 1.80 mm and the coupling recesses are sized to have an interference fit with the coupling studs. An interference fit is a friction fit in which the fastening between the coupling elements is achieved by friction after the coupling elements are pushed together. The interference fit can also involve a purposeful interference or deformation of one or more of the coupling elements when they are fastened or pushed together. Thus, the interference fit can be achieved by shaping the two coupling elements so that one or the other, or both, slightly deviate in size from their nominal dimension and one or more of the coupling elements slightly interferes with the space that the other is taking up. The toy construction kit can also include other building elements that include one or more accessory coupling elements that have a second coupling size that is distinct from (for example, smaller than) the first coupling size so that the accessory coupling elements are not able to frictionally engage with the coupling elements of the standard building elements. For example, the second coupling size of standard accessories such as rods and guns that are held by toy figures are defined by a diameter of 3.18 mm.

As shown, the assembly of the parts of the toy FIG. 10 includes mating parts that can be interconnected to construct the toy FIG. 10. The mating parts of the assembly include the head part 20, the upper body part 40, the arm parts 60, and the lower body part 80. Some of the mating parts of the assembly are structured for friction fit attachment, which can be an interference fit. In particular, each of the head part 20 and the lower body part 80 is structured for friction fit attachment to the upper body part 40. Each of the arm parts 60 is structured for a snap fit with a seating engagement attachment to the upper body part 40. Additionally, each of the arm parts 60 can be identical to reduce the number of different parts to be manufactured for the toy figure assembly. In some cases, the head part 20 is a standard head of a different type of toy figure to reduce the number of parts across multiple product lines.

As discussed below, each of the upper body part 40 and the lower body part 80 is designed with one or more coupling elements of first and second coupling sizes. In this way, the upper body part 40 and the lower body part 80 can, in addition to being able to be attached to each other and to the head part 20 and arm parts 60 (for the upper body part 40), also be attached to standard building elements (having a first coupling size) of the toy construction kit, accessories (having a second coupling size) of the toy construction kit, or both standard building elements and accessories. This enables the body parts 40, 80 to be used with other pieces of the toy construction kit and promotes play and creativity on the part of the end user.

Figure 3C:
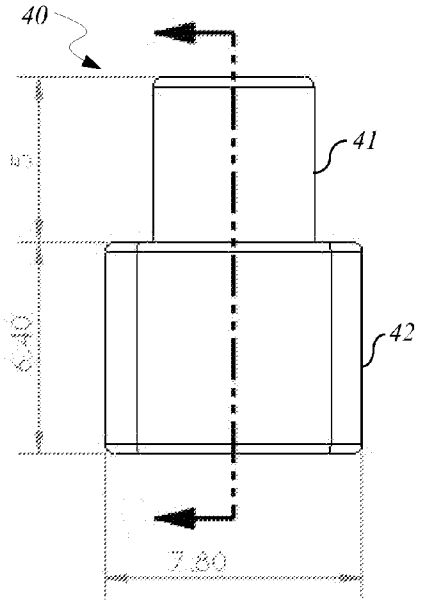
FIG. 3C is a side plan view of the exemplary upper body part of FIG. 3A.
Figure 3B:
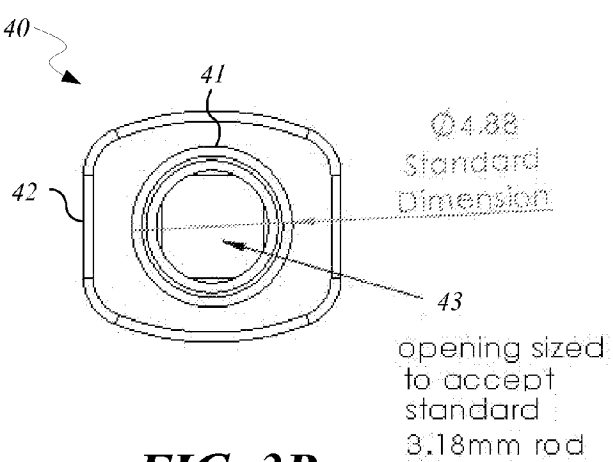
FIG. 3B is a top plan view of the exemplary upper body part of FIG. 3A.
Figure 3A:
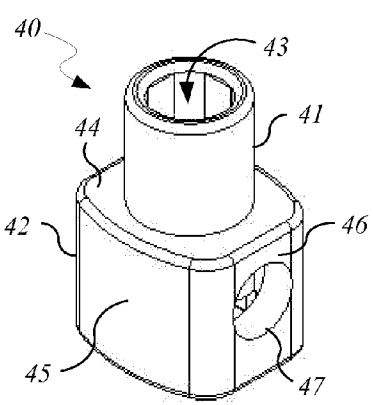
FIG. 3A is a perspective view of an exemplary upper body part of the toy figure of FIGS. 1 and 2.

FIGS. 3A-3F illustrate an exemplary upper body part 40. Referring to FIG. 3A, the upper body part 40 includes a neck portion 41 and a trunk portion 42, and can be designed and/or manufactured as a unitary workpiece. In this way, when the upper body part 40 is implemented as a unitary workpiece, the neck portion 41 and the trunk portion 42 do not move relative to each other. The neck portion 41 is structured to attach to the head part 20 of the toy FIG. 10 (shown in FIG. 2, for example) or a standard head of a different type of toy figure. The head part 20 can be a cored out piece formed with an opening and cavity sized to receive the neck portion 41 and can rotate when mounted to the neck portion 41. As shown, the neck portion 41 is structured as a hollow, cylindrical post extending from the trunk portion 42. The top end of the neck portion 41 is formed with an opening 43, and the inner surface of the opening 43 defines a through hole or passage that extends through the neck portion 41 and opens into an interior of the trunk portion 42.

The trunk portion 42 is a hollow piece that includes a top surface 44, a front wall 45, a left wall 46, a rear wall (opposite the front wall 45), and a right wall (opposite the left wall 46). The bottom surfaces of the front wall 45, the left wall 46, the rear wall, and the right wall define an open bottom end of the trunk portion 42. As shown, the trunk portion 42 can have rounded corners and edges. The surfaces of the front wall 45 and the rear wall each may curve outwardly and have an identical shape. As such, the front wall 45 or the rear wall each can represent the chest or back of the toy FIG. 10 depending on the attachment and orientation of other mating parts. A bore 47 or arm socket is provided in each of the left wall 46 and the right wall. Each respective bore 47 passes completely through the left wall 46 or the right wall and opens into the interior of the trunk portion 42, as described and shown below.

In one or more implementations, the upper body part 40 is designed and/or manufactured to have dimensions that correspond to certain dimensions of a standard building element, stud, and/or accessory included in a toy construction kit. For instance, a standard building element (for example, a 1×1 brick or plate) can have a length of 7.80 mm, a width of 7.80 mm, and a height of 3.20 mm (not including the stud). A standard stud (on the surface of a building element) can have a diameter of 4.88 mm and a height of 1.80 mm. Standard accessories held by toy figures can have a diameter of 3.18 mm. As an example, the size of the neck portion 41 can allow for the attachment of a standard building element, such as a 1×1 element or plate, or any building element that accepts a stud connection. Moreover, the opening 43 can be sized to accept any standard accessory such as a 3.18 mm rod and such accessory can extend through the upper body part 40.

Referring to FIG. 3B, as an example, the neck portion 41 can have an outer diameter of 4.88 mm corresponding to the diameter of standard stud. It can be appreciated that the opening and cavity formed in the head part 20 of the toy FIG. 10 (shown in FIG. 2, for example) can be sized to receive the neck portion 41 as well as a standard stud. The opening 43 and the through hole in the neck portion 41 can be sized to accept a standard 3.18 mm rod as well as other construction toy kit accessories having a standard 3.18 mm diameter.

Referring to FIG. 3C, as another example, the neck portion 41 can have a height of 5.00 mm as measured from the trunk portion 42. As such, the top of the neck portion 41 will line up with the top of a stud on an adjacent stack of five plates when the upper body part 40 is attached to the lower body part 60.

The trunk portion 42 can have a height dimension of 6.40 mm corresponding to the height of two standard building element plates and a width dimension of 7.80 mm corresponding to the width of a standard building element brick. Typically, the length dimension of the trunk portion 42 can be sized to match the shape of the top of the lower body part 80.

Figure 3F:
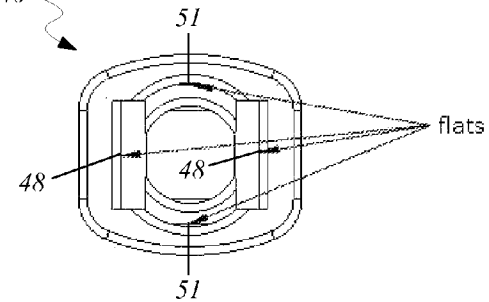
FIG. 3F is a bottom plan view of the exemplary upper body part of FIG. 3A.
Figure 3E:
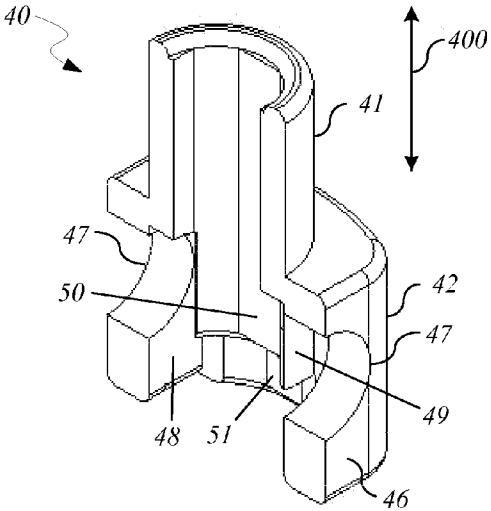
FIG. 3E is a cutaway perspective view of the exemplary upper body part of FIG. 3A.
Figure 3D:
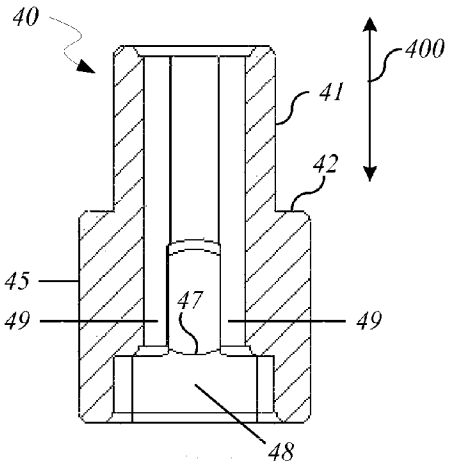
FIG. 3D is a side cross-sectional view of the exemplary upper body part of FIG. 3A taken along the line of FIG. 3C.

FIG. 3D illustrates a sectional view of the upper body part 40 based on the cutting plane shown in FIG. 3C. In particular, FIG. 3D illustrates an interior view of the neck portion 41 and the right wall of the trunk portion 42. As shown, the right wall of the trunk portion 42 includes a flat inside surface 48 around the bore 47. In this implementation, the left wall 46 and the right wall are similarly structured. Accordingly, the left wall 46 also includes a corresponding flat inside surface 48 around the bore 47.

The trunk portion 42 includes interior sidewalls 49 that project into the interior of the trunk portion 42 and are visible through the bore 47. As shown, the interior sidewalls 49 extend longitudinally (that is, along a longitudinal axis 400) along the inner surfaces of the front wall 45 and the rear wall. In this implementation, two interior sidewalls 49 project from the inner surface of the front wall 45 and two interior sidewalls 49 project from the inner surface of the rear wall.

FIG. 3E illustrates a section of the upper body part 40 showing an interior view of the neck portion 41 and the trunk portion 42. As shown, an outer surface (the surface facing the outside of the trunk portion 42) of one of the interior sidewalls 49 is visible through the bore 47. The outer surfaces of the interior sidewalls 49 are spaced apart from the flat inside surfaces 48 of the left wall 46 and the right wall. Accordingly, each of the arm parts 80 contacts outer surfaces of interior sidewalls 49 when received into a corresponding bore 47.

The inner surface of the rear wall of the trunk portion 42 includes an upper longitudinal flat 50, which extends longitudinally along the inner surface of the rear wall of the trunk portion 42. In one or more implementations, the upper longitudinal flat 50 also extends longitudinally along the inner surface of the neck portion 41. Within the trunk portion 42, the inner surfaces of the interior sidewalls 49 that project from the rear wall of the trunk portion 42 abut the upper longitudinal flat 50 to define a track or channel that communicates with the through hole provided by the inner surface of the neck portion 41. In this example, the front wall 45 and the rear wall are similarly structured. Accordingly, the front wall 45 also includes a corresponding upper longitudinal flat 50 that extends longitudinally along the inner surface of the front wall 45 of the trunk portion 42 and the inner surface of the neck portion 41. Within the trunk portion 42, the inner surfaces of the interior sidewalls 49 that project from the front wall 45 of the trunk portion 42 abut the corresponding upper longitudinal flat 50 to define another track or channel that communicates with the through hole provided by the inner surface of the neck portion 41. Each channel can be formed such that the inner surface of the neck portion 41 is flush with the inner surfaces of the interior sidewalls 49 that project from the front wall 45 and the rear wall of the trunk portion 42 and the inner surface of each upper longitudinal flat 50.

The inner surface of the rear wall of the trunk portion 42 also includes a lower longitudinal flat 51. As shown, the lower longitudinal flat 51 is provided in the inner surface of the rear wall of the trunk portion 42 vertically below the upper longitudinal flat 50. The lower longitudinal flat 51 also is formed deeper into the inner surface of the rear wall of the trunk portion 42 than the upper longitudinal flat 50. In this example, the front wall 45 and the rear wall are similarly structured. Accordingly, a corresponding lower longitudinal flat 51 is provided in the inner surface of the front wall 45 of the trunk portion 42.

In one or more implementations, each lower longitudinal flat 51 provided in the inner surfaces of the front wall 45 and the rear wall is structured and arranged for attaching the upper body part 40 to the lower body part 80 or to a standard coupling stud (having a diameter of 4.88 mm). For instance, the trunk portion 42 can attach to a building element (for example, a brick or a plate) via only a single stud on the building element. Each lower longitudinal flat 51 can cooperate with each flat inside surface 48 provided in the left wall 46 and the right wall to engage the periphery of a standard stud. The bottom surfaces of each of the interior sidewalls 49 and the bottom surface of each upper longitudinal flat 50 can be spaced apart from the bottom surface of the trunk portion 42 for receiving a standard stud and can provide stops that abut the top surface of a standard stud received by the trunk portion 42. Additionally, the trunk portion 42 can also receive an accessory through the opening in the bottom, such accessory being able to extend all the way up through the opening 43 and engage with the upper longitudinal flat 50.

Referring to FIG. 3F, a bottom view of the upper body part 40 shows the position of each flat inside surface 48 and each lower longitudinal flat 51 in one or more implementations. As shown, each flat inside surface 48 and each lower longitudinal flat 51 is positioned at a standard 90 degrees to one another. In some implementations, different longitudinal flats at different positions can be used. For example, four longitudinal flats formed in the inner surfaces of the front wall 45 and the rear wall and positioned at an acute angle (for example, 63°9'44") relative to one another can be used. Moreover, the longitudinal flats can be positioned and dimensioned to provide the necessary interference for allowing the trunk portion 42 to attach to a standard stud or to the lower body part 80.

Figure 4B:
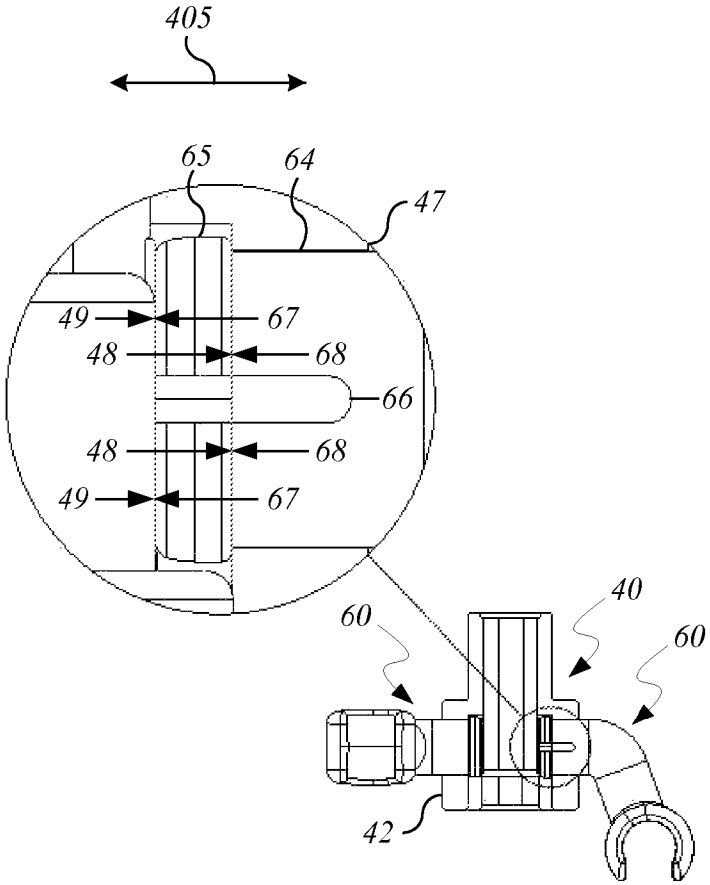
FIG. 4B is a side cross-sectional view of the exemplary upper body part and the arm parts of FIG. 4A.
Figure 4A:
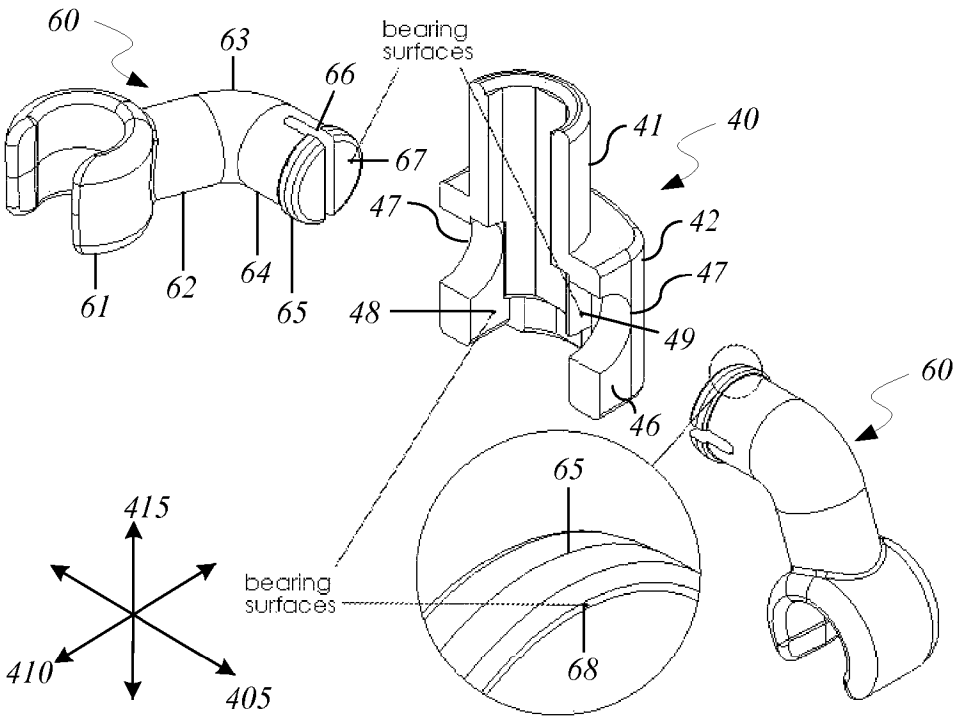
FIG. 4A is an exploded perspective view of the exemplary upper body part of FIG. 3A and including exemplary arm parts.

FIGS. 4A-4E illustrate attachment of the upper body part 40 and the arm parts 60 according to one or more implementations. Referring to FIG. 4A, each of the arm parts 60 includes a hand portion 61, a forearm portion 62, an elbow portion 63, an upper arm portion 64, and a shoulder portion 65. Each of the arm parts 60 can be designed and/or manufactured as a unitary workpiece. In this way, when each of the arm parts 60 is implemented as a unitary workpiece, the hand portion 61, the forearm portion 62, the elbow portion 63, the upper arm portion 64, and the shoulder portion 65 do not permit movement relative to each other. As shown, the hand portion 61, the forearm portion 62, the elbow portion 63, the upper arm portion 64, and the shoulder portion 65 can have various rounded corners and edges.

In one or more implementations, the hand portion 61 is structured as a C-shaped grip provided at the distal end of each of the arm parts 60. The elbow portion 63 is structured as a curved section between the forearm portion 62 and the upper arm portion 54. The shoulder portion 65 is provided at the proximal end of each of the arm parts 60 and is structured as a snap joint, flange, or collar having a diameter greater than the diameter of the upper arm portion 64. To facilitate attachment to the upper body part 40, each of the arm parts 60 includes an axial relief slot 66 that splits the entire shoulder portion 65 and a section of the upper arm portion 64. The relief slot 66 bifurcates the proximal end of each of the arms parts 60 such that each shoulder portion 65 includes two bottom faces 67 (for example, C-shaped or D-shaped surfaces) perpendicular to the periphery of the shoulder portion 65 and two top faces 68 (for example, C-shaped ledges) perpendicular to the periphery of the shoulder portion 65.

As shown, the two bottom faces 67 and the two top faces 68 of each shoulder portion 65 define or act as bearing surfaces for contacting corresponding bearing surfaces defined or acting within the trunk portion 42 of the upper body part 40. Each flat inside surface 48 provided around each bore 47 in the left wall 46 and in the right wall defines or acts as a bearing surface within the trunk portion 42. In addition, outside surfaces of the interior sidewalls 49 projecting from the front wall and rear wall within the trunk portion 42 define or act as bearing surfaces. In this way, twisting of the arm parts 60 is prevented or greatly hindered when the upper body part 40 and the arm parts 60 are assembled and the bearing surfaces defined by the shoulder portion 65 are in contact with the bearing surfaces defined within the trunk portion 42. Twisting is defined as any rotation of the arm part 60 about an axis that is defined within the plane of the opening of the bore 47, such plane being perpendicular to an arm axis 405. As shown in FIG. 4A, the plane of the opening of the bore 47 is defined by axes 410, 415. Twisting is prevented or hindered because twisting in this manner exerts a force that could detach or pop the arm part 60 from the trunk portion 42.

In general, the arm parts 60 are attachable to and rotatable within the upper body part 40 by a snap fit engagement with a seating (defined by the engagement between the bearing surfaces) about the arm axis 405 to provide articulation to the toy FIG. 10. Each of the arm parts 60 can be identical and can represent either the left arm or the right arm of the toy FIG. 10 depending on the attachment and orientation of the arms parts 60 and/or other mating parts. In some cases, the upper body part 40 and the arm parts 60 are assembled when packaged.

Figure 4D:
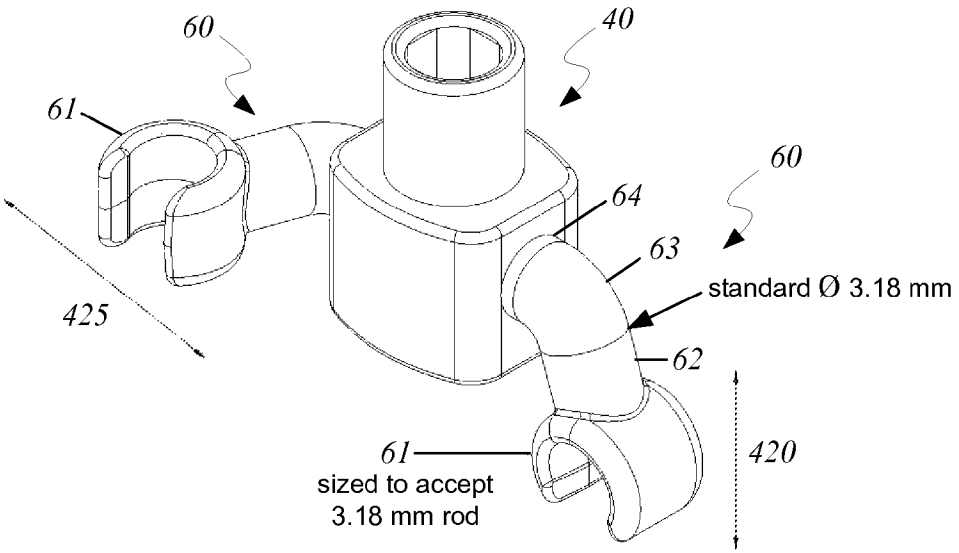
FIG. 4D is a perspective view of the exemplary upper body part and arm parts of FIG. 4A.
Figure 4C:
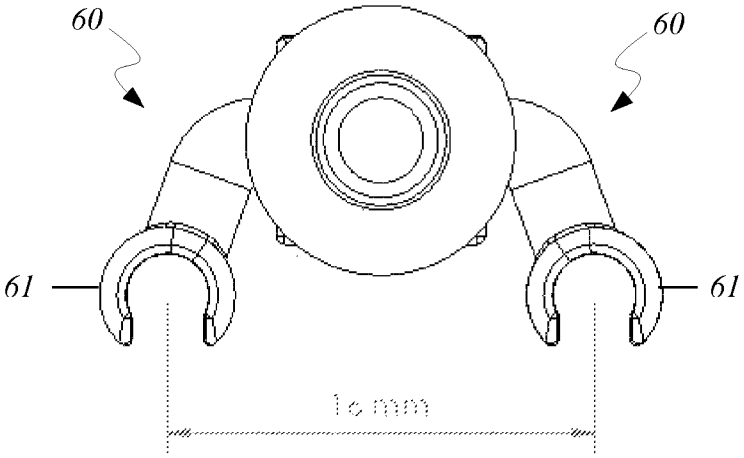
FIG. 4C is a top plan view of the exemplary upper body part and the arm parts of FIG. 4A.
Figure 4E:
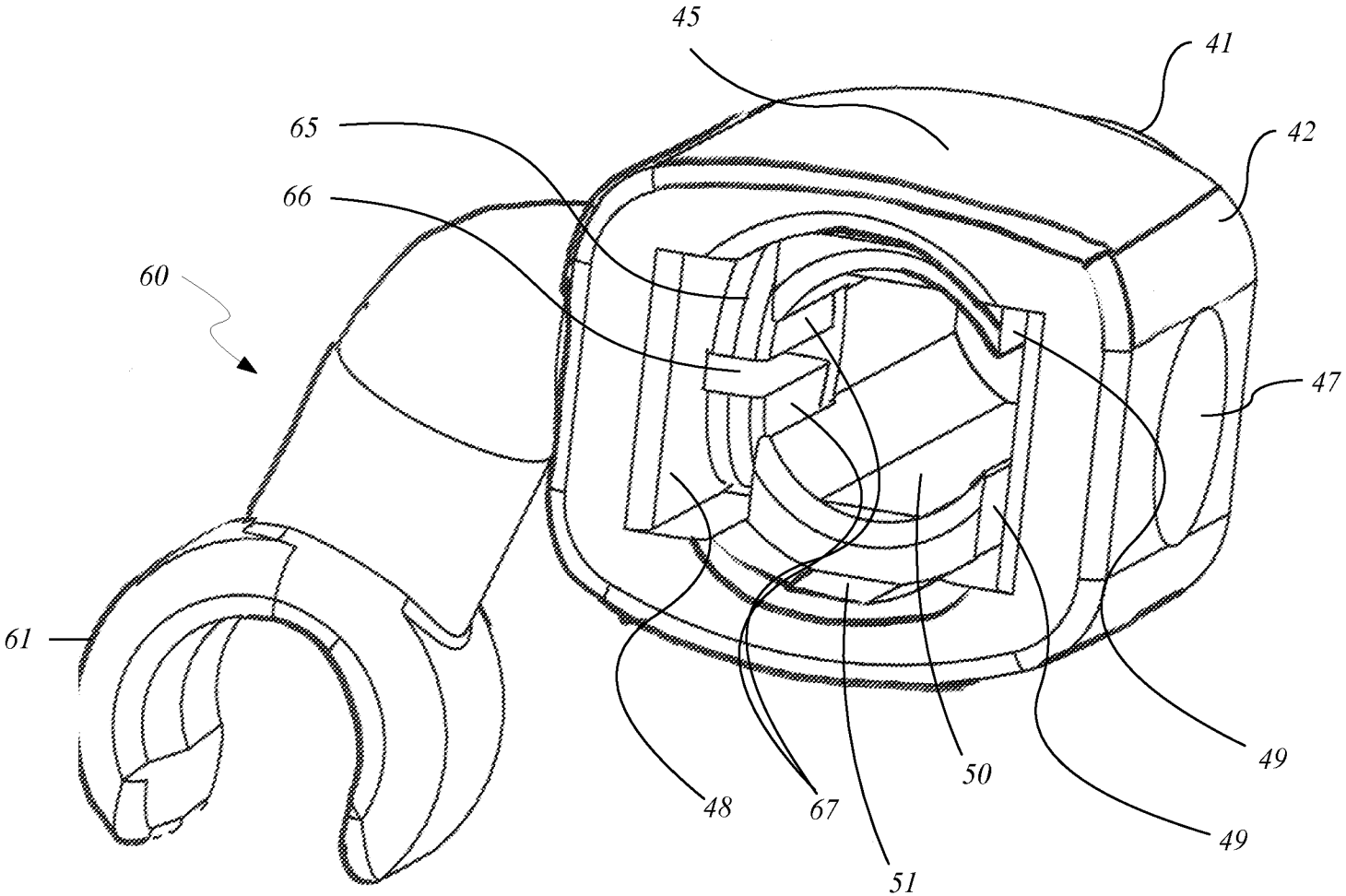
FIG. 4E is a perspective view of an exemplary upper body part and an arm part of FIG. 4A in which an interior detail is shown.

Referring to FIGS. 4B and 4E, the upper body part 40 attaches to each of the arm parts 60 by receiving the entire shoulder portion 65 and at least the section of the upper arm portion 64 that includes the relief slot 66 through a bore 47 and into the interior of the trunk portion 42. Each relief slot 66 is not visible from the outside of the assembly when the upper body part 40 and the arm parts 60 are assembled regardless of the orientation of each relief slot 66. The arm parts 60 are inserted into the upper body part 40 by a snap fit connection; in which the two sides of the shoulder portion 65 (including the two bottom faces 67 and two top faces 68 move toward each other and the relief slot 66 compresses as the arm parts 60 are first inserted into the bore 47 and then once the shoulder portion 65 clears the bore 47, the relief slot 66 snaps open.

As shown, when the relief slot 66 is oriented in a horizontal position, bearing surfaces defined by two (upper and lower) bottom faces 67 of the shoulder portion 65 (for example, the left arm) contact a bearing surface defined by the outside surface of one of the interior sidewalls 49 projecting from the rear wall of the trunk portion 42. Moreover, the bearing surfaces defined by the same two (upper and lower) bottom faces 67 of the shoulder portion 65 (for example, the left arm) also contact a bearing surface defined by the outside surface of one of the interior sidewalls 49 projecting from the front wall of the trunk portion 42. In addition, bearing surfaces defined by two (upper and lower) top faces 68 of the shoulder portion 65 (for example, the left arm) contact a bearing surface defined by the flat inside surface 48 around the bore 47 of the left wall 46.

When the relief slot 66 is in a vertical position, bearing surfaces defined by two (left and right) bottom faces 67 of the shoulder portion (for example, the right arm) contact bearing surfaces defined by the outside surfaces of two sidewalls 49—one projecting from the rear wall of the trunk portion 42 and one projecting from the front wall of the trunk portion 42. In addition, bearing surfaces defined by two (left and right) top faces 68 of the shoulder portion 65 (for example, the right arm) contact a bearing surface defined by the inside surface 48 around the bore 47 of the right wall.

In one or more implementations, each of the arm parts 60 is designed and/or manufactured to have dimensions that correspond to certain dimensions of a standard building element, stud, and/or accessory included in a construction toy kit. Referring to FIG. 4C, as an example, the center-to-center distance between each hand portion 61 may be 16.00 mm corresponding to the center-to-center distance between three studs. Referring to FIG. 4D, as another example, the hand portion 61 can be structured to securely hold standard 3.18 mm rods and/or accessories. Each of the forearm portion 62, the elbow portion 63, and the upper arm portion 64 of one of the arm parts 60 can have a standard 3.18 mm diameter for allowing such portions to be held by a hand portion 61 of a different one of the arm parts as well as by other types of holding pieces included in construction toy kits.

As mentioned, each of the arm parts 60 can rotate about the arm axis 405 within the upper body part 40 to provide articulation. When the upper body part 40 and the arm parts 60 are assembled, each of the arm parts 60 can be rotated about the arm axis 405 and posed at any angular position. In general, the connection between the arm parts 60 and the upper body part 40 must be tight enough so that each of the arms parts 60 can maintain any angular position when an accessory is held by the hand portion 61. The connection also must be loose enough so that each of the arm parts 60 can be repositioned without overcoming the interference force holding the toy FIG. 10 to a building element (for example, a brick or a plate) and detaching the toy FIG. 10 from a stud to which the toy FIG. 10 is attached, as discussed in greater detail below. In addition, the connection between the arm parts 60 and the upper body part 40 must be stable enough so that each arm part 60 does not twist or wobble as discussed above when a moment or cantilever force is applied to the hand portion 61 in the directions indicated by arrows 420, 425 in FIG. 4D.

Figure 5C:
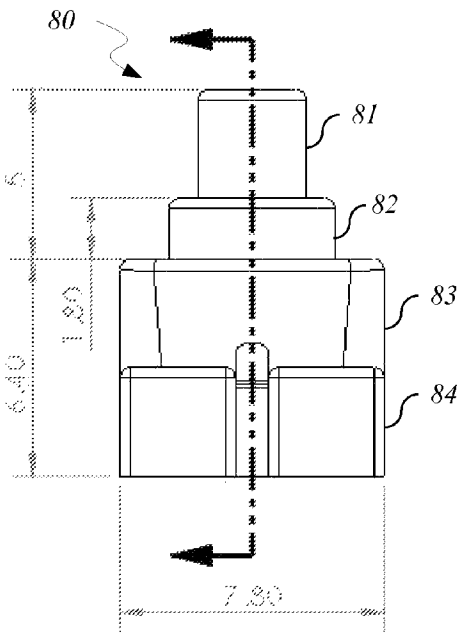
FIG. 5C is a side plan view of the exemplary lower body part of FIG. 5A.
Figure 5B:
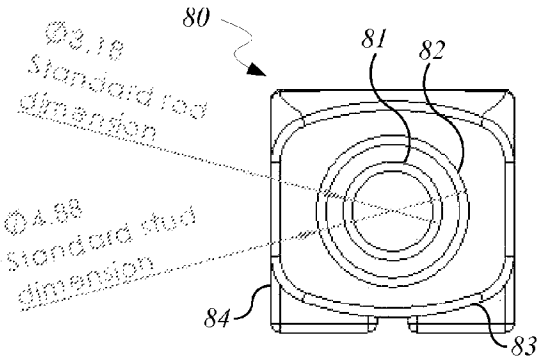
FIG. 5B is a top plan view of the exemplary lower body part of FIG. 5A.
Figure 5E:
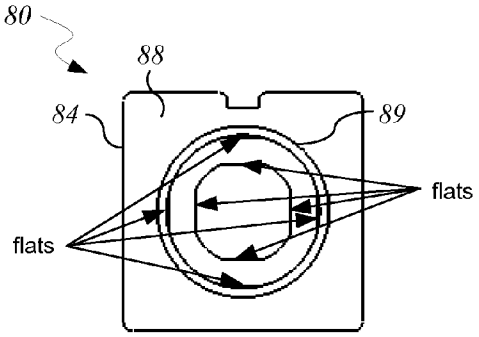
FIG. 5E is a bottom plan view of the exemplary lower body part of FIG. 5A.
Figure 5A:
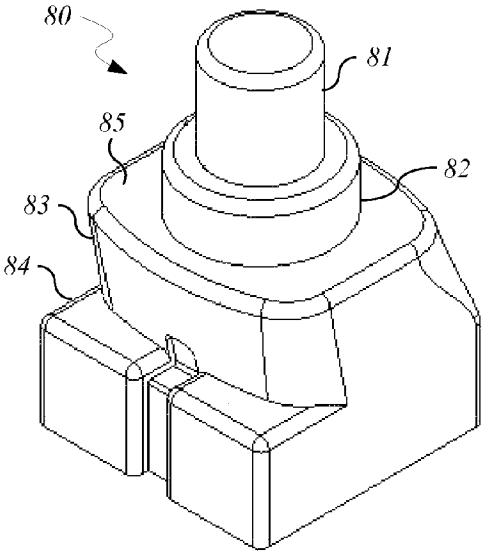
FIG. 5A is a perspective view of an exemplary lower body part of the toy figure of FIGS. 1 and 2.

FIGS. 5A-5E illustrate a lower body part 80 according to one or more implementations. Referring to FIG. 5A, the lower body part 80 includes a rod portion 81, a stud portion 82, a legs portion 83, and a feet portion 84, and it can be designed and/or manufactured as a unitary workpiece. In one or more implementations, the legs portion 83 represents both legs of the toy FIG. 10, and the feet portion 84 represents both feet of the toy FIG. 10. Thus, when the lower body part 80 is implemented as a unitary workpiece, the rod portion 81, the stud portion 82, the legs portion 83, and the feet portion 84 do not permit movement relative to each other. As shown, the rod portion 81, the stud portion 82, the legs portion 83, and the feet portion 84 can optionally have various rounded corners and edges.

In one or more implementations, the rod portion 81 and the stud portion 82 are formed as solid structures to be received by the trunk portion 42 of the lower body part 40 (shown in FIG. 3A, for example). The stud portion 82 protrudes from a top surface 85 of the legs portion 83, and the rod portion 81 protrudes from the stud portion 82. As shown, the legs portion 83 can have curved or angled front and rear surfaces and substantially flat side surfaces that are coplanar with substantially flat side surfaces of the feet portion 84.

In one or more implementations, the lower body part 80 is designed and/or manufactured to have dimensions that correspond to certain dimensions of a standard building element, stud, and/or accessory included in a construction toy kit. Referring to FIG. 5B, as an example, the rod portion 81 can have an outer diameter of 3.18 mm corresponding to the diameter of standard rod or accessory, and the stud portion 82 can have an outer diameter of 4.88 mm corresponding to the diameter of standard stud. As mentioned above, the opening and cavity formed in the head part 20 of the toy FIG. 10 (shown in FIG. 2, for example) can be sized to receive a standard stud. As such, the stud portion 82 can be used to attach the head part 20 of the toy FIG. 10 or the standard head of a different type of toy figure to the legs portion 83.

Referring to FIG. 5C, as another example, the combination of the legs portion 83 and the feet portion 84 can have a height dimension of 6.40 mm corresponding to the height of two standard building element plates. The stud portion 82 can have a height dimension of 1.80 mm corresponding to the height of standard stud. The combination of the rod portion 81 and the stud portion 82 can have a height of 5.00 mm as measured from the top of the legs portion 83. As such, the top of the rod portion 81 lines up with the top of a stud on an adjacent stack of three plates. The base portion can have a length dimension of 7.80 mm and a width dimension of 7.80 mm to provide a footprint equivalent to a standard building element (for example, a 1×1 brick or plate).

Figure 5D:
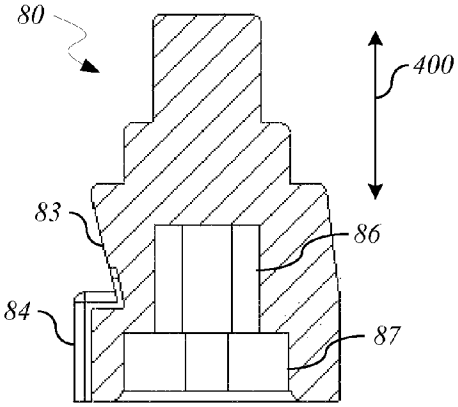
FIG. 5D is a cross-sectional view of the exemplary lower body part of FIG. 5A taken along the line of FIG. 5C.

FIG. 5D illustrates a sectional view of the lower body part 80 based on the cutting plane shown in FIG. 5C. In particular, FIG. 5D illustrates an interior view of the legs portion 83 and the feet portion 84. In one or more implementations, the interior geometry of the lower body part 80 allows for connection with a standard stud on a building elements as wells as a standard 3.18 mm rod or another lower body part 80. As shown, the interior of the lower body part 80 includes an upper cavity 86 and a lower cavity 87. The upper cavity 86 longitudinally extends (that is, along the longitudinal axis 400) within the legs portion 83 and the feet portion 84, and is sized to receive a standard 3.18 mm rod or the rod portion 81 of another lower body part 80. The lower cavity longitudinally extends within the feet portion 87 and is sized to receive a standard stud or the stud portion 82 of another lower body part 80.

FIG. 5E illustrates a bottom view of the lower body part 80. As shown, a bottom surface 88 of the feet portion 84 defines a single opening 89 into the interior of the lower body part 80. The opening 89 communicates with the lower cavity 87 and allows the feet portion 84 to attach to a standard building element (for example, a brick or a plate) via only a single stud on the building element. As shown, longitudinal flats can be formed in the interior surfaces of the legs portion 83 and the feet portion 84, which define, respectively, the lower cavity 86 and the upper cavity 87. Moreover, the longitudinal flats can be positioned and dimensioned based on the standard dimensions of structures to be received in the lower cavity 86 and the upper cavity 87.

Figure 6:
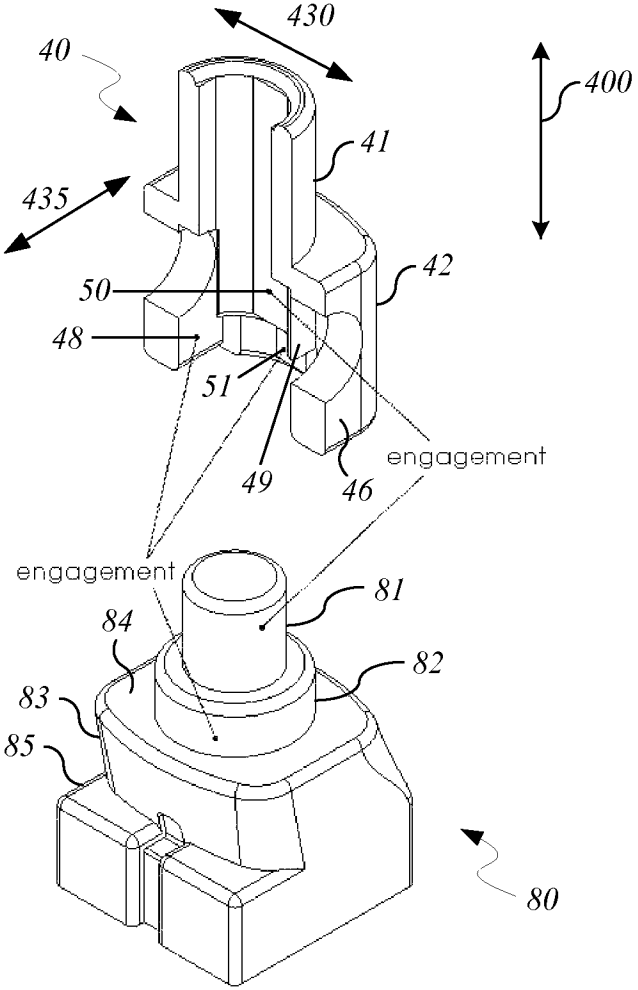
FIG. 6 is a perspective view of an exemplary upper body part and an exemplary lower body part of the toy figure of FIGS. 1 and 2.

FIG. 6 illustrates an exemplary attachment of the upper body part 40 and the lower body part 80. As shown, the interior of the upper body part 40 is structured to accommodate the rod portion 81 and the stud portion 82 combination of the lower body part 80. In general, when the upper body part 40 and the lower body part 80 are assembled, the upper body part 40 can rotate relative to the lower body part 80 about the longitudinal axis 400 to provide articulation (for example, a waist rotation). The connection between the upper body part 40 and the lower body part 80 must be stable enough so that there should be no noticeable wobble that allows the parts to begin to separate when a back and forth force is applied across the upper body part 40 at the top of the neck portion 41 in the directions 430, 435 indicated.

In one or more implementations, the upper body part 40 attaches to the lower body part 80 by receiving the rod portion 81 and the stud portion into the interior of the trunk portion 42. Within the trunk portion 42, each upper longitudinal flat 50 provided in the inner surfaces of the front wall and the rear wall is structured and arranged for engaging the rod portion 81 of the lower body part 80. The upper longitudinal flat 50 in the inner surface of the front wall can cooperate with the inner surfaces of the interior sidewalls 49, which project from the front wall to define a track that engages the rod portion 81. The upper longitudinal flat 50 in the inner surface of the rear wall can cooperate with the inner surfaces of the interior sidewalls 49, which project from the rear wall to define a track that engages the rod portion 81. The bottom surfaces of each of the interior sidewalls 49 and the bottom surface of each upper longitudinal flat 50 can be spaced apart from the bottom surface of the trunk portion 42 for receiving the stud portion 82 of the lower body part 80. As such, the bottom surfaces of each of the interior sidewalls 49 and the bottom surface of each upper longitudinal flat 50 can provide stops that abut the top surface of the stud portion 82 when received into the interior of the trunk portion 42.

Each lower longitudinal flat 51 provided in the inner surfaces of the front wall 45 and the rear wall is structured and arranged for engaging the stud portion 82 of the lower body part 80. Each lower longitudinal flat 51 can cooperate with each flat inside surface 48 provided in the left wall 46 and the right wall to engage the periphery of the stud portion 82 of the lower body part. When assembled, the bottom surface of the upper body part 40 abuts the top surface 84 of the feet portion 83 of the lower body part 80.

When the upper body part 40 is attached to lower body part 80 and the arm parts 60, each flat inside surface 48 in the left wall 46 and in the right wall of the trunk portion 42 provides a bearing surface that contacts the top faces 68 of the shoulder portion 65 (shown in FIG. 4A, for example) as well as an engagement surface which contacts the stud portion 82 of the lower body part 80.

Figure 7:
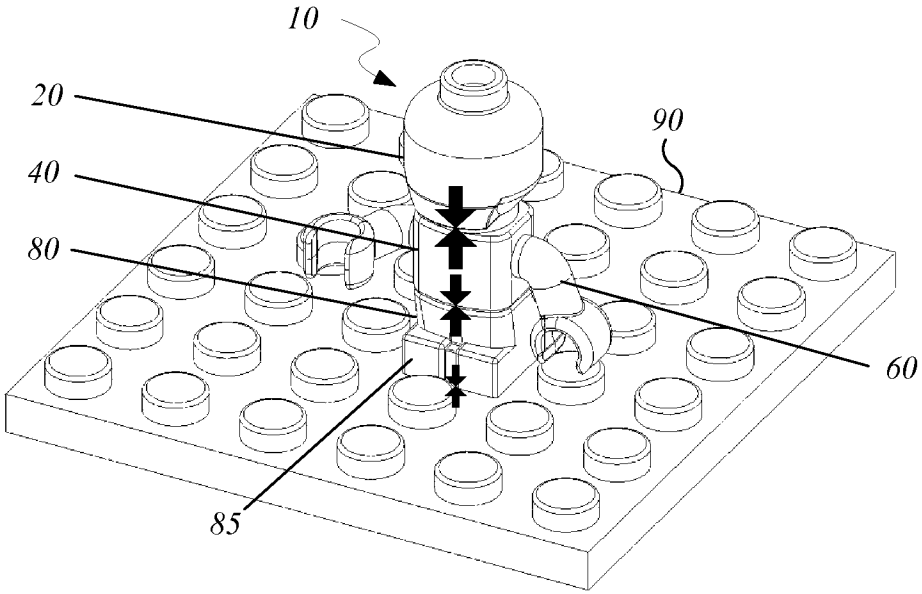
FIG. 7 is a perspective view of the toy figure of FIGS. 1 and 2 attached to a toy building element.

FIG. 7 illustrates an exemplary attachment of the toy FIG. 10 to a building element 90. As shown in this example, the building element 90 is structured as a 6×6 plate having an array of standard studs, but the building element 90 can have any geometry that includes one or more studs. The toy FIG. 10 is assembled using mating parts including the head part 20, the upper body part 40, the arm parts 60, and the lower body part 80. The lower body part 80 of the toy figure can attach to the building element 90 via only a single stud on the building element 90.

When the toy FIG. 10 is assembled and attached to the building element 90, there is a hierarchy of interference forces in effect. The strongest connection, which has the greatest interference force, is between the head part 20 and the upper body part 40. The next strongest connection is between the upper body part 40 and the lower body part 80. The weakest connection, which has the weakest interference force, is between the lower body part 80 and the stud on the building element 90. The interference force between the lower body part 80 and the stud on the building element 90 typically should be in line with the interference force between building elements (for example, the interference force between a standard 1×1 plate and another plate). This hierarchy of interference forces allows the assembled toy FIG. 10 to be removed from the building element 90 as a single unit when the toy FIG. 10 is pulled only by the head part 20. In other words, the entire assembled toy FIG. 10 can be removed from the building element 90 by pulling up on the head part 20 without having to grab or contact the upper body part 40, the lower body part 80, or the arm parts 60.

The connection between the upper body part 40 and the arm parts 60 must be tight enough so that each of the arms parts 60 can maintain any angular position yet loose enough so that each of the arm parts 60 can be repositioned without overcoming the interference force between the lower body part 80 and the stud on the building element 90. The connection between the upper body part 40 and the lower body part 80 must be stable enough so that there should be no noticeable wobble that begins to separate upper body part 40 and the lower body part 80 when a back and forth (shoulder to shoulder) force is applied across the top of the head part 20.

While certain features of the implementations have been illustrated and described, many modifications, substitutions, changes and equivalents are possible. It is therefore to be understood that the appended claims are intended to cover all such modifications and changes as fall within the true spirit of the implementations.

What is claimed is:

1. A toy figure assembly comprising:

an upper body part defining a side bore and at least two interior bearing surfaces that are parallel with each other;

an arm part comprising:

a non-shoulder portion, and a shoulder portion adjacent the non-shoulder portion and having an outer diameter greater than an outer diameter of the non-shoulder portion, the shoulder portion having at least two shoulder bearing surfaces that are both perpendicular with a periphery of the shoulder portion and extend along a plane that is perpendicular to an axis of the arm part, and an axial relief slot that extends through the shoulder portion to divide each shoulder bearing surface into at least two faces, the axial relief slot extending across the two shoulder bearing surfaces toward the non-shoulder portion along the axis of the arm part; and a lower body part attached to the upper body part;

wherein:

at least one of the upper body part and the lower body part includes a recess for frictionally engaging a stud of a toy building element;

when the arm part is snap fit through the bore of the upper body part, the at least two shoulder bearing surfaces of the shoulder portion abut the at least two interior bearing surfaces of the upper body part, respectively, and the arm part rotates relative to the upper body part about the axis of the arm part; and the shoulder bearing surfaces of the shoulder portion are seated between the at least two interior bearing surfaces of the upper body part after the arm part is snap fit through the bore of the upper body part.

2. The toy figure assembly of claim 1, wherein the upper body part comprises a neck portion and a trunk portion, the neck portion projecting from a top surface of the trunk portion and having an inner surface defining a through hole that opens into the trunk portion.

3. The toy figure assembly of claim 2, wherein:

a first of the interior bearing surfaces of the upper body part extends from a neck portion into a trunk portion that defines the side bore, the first of the interior bearing surfaces facing the bore; and a second of the interior bearing surfaces of the upper body part is a flat inside surface of the trunk portion that defines the side bore, the second of the interior bearing surfaces facing the first of the interior bearing surfaces.

4. The toy figure assembly of claim 2, wherein the trunk portion includes a front wall, a rear wall, and a side wall connecting the front and rear walls, one of the walls defining the side bore and the flat inside surface.

5. The toy figure assembly of claim 1, further comprising a plurality of arm parts, each arm part being identical to each other.

6. The toy figure assembly of claim 1, wherein the axial relief slot splits the shoulder portion and a section of the non-shoulder portion.

7. The toy figure assembly of claim 6, wherein the upper body part attaches to the arm part by receiving the entire shoulder portion and at least the section of the non-shoulder portion that includes the relief slot into a trunk portion of the upper body part.

8. The toy figure assembly of claim 1, wherein the axial relief slot divides one of the shoulder bearing surfaces into two bottom faces perpendicular to the periphery of the shoulder portion, the bottom faces define shoulder bearing surfaces for contacting corresponding interior bearing surfaces defined by interior sidewalls within the upper body part.

9. The toy figure assembly of claim 8, wherein the axial relief slot divides another of the shoulder bearing surfaces into two top faces perpendicular to the periphery of the shoulder portion, the top faces define shoulder bearing surfaces for contacting corresponding interior bearing surfaces defined by a flat inside surface of the upper body part.

10. The toy figure assembly of claim 5, wherein the non-shoulder portion of each arm part comprises:

a hand portion, a forearm portion, an elbow portion, and an upper arm portion adjacent the shoulder portion.

11. The toy figure assembly of claim 10, wherein a center-to-center distance between each hand portion corresponds to a center-to-center distance between studs of a building element.

12. The toy figure assembly of claim 10, wherein each forearm portion, elbow portion, and upper arm portion of one of the arm parts has a standard diameter capable of being held by a hand portion of a different one of the arm parts.

13. A toy figure assembly comprising:

an upper body part including a neck portion and a trunk portion, the neck portion projecting from a top surface of the trunk portion and having an inner surface defining a through hole that opens into the trunk portion and extends through the trunk portion along a longitudinal axis of the upper body part, the trunk portion including: a front wall, a rear wall, a side wall defining a side bore and having a flat inside surface, wherein an inner surface of the front wall and an inner surface of the rear wall each include: an upper longitudinal flat, interior sidewalls which abut the upper longitudinal flat, and a lower longitudinal flat, with each upper longitudinal flat being structured to cooperate with the interior sidewalls to define a first track that extends along the longitudinal axis of the upper body part and each lower longitudinal flat being structured to cooperate with the flat inside surface of the side wall to define a second track that extends along the longitudinal axis of the upper body part; and a lower body part structured for friction fit attachment to the upper body part along the longitudinal axis of the upper body part, the lower body part including a rod portion having an outer rod diameter, a stud portion having an outer stud diameter that is larger than the outer rod diameter, a legs portion, and a feet portion, wherein the first track frictionally engages the rod portion when the rod portion is received into the trunk portion, and wherein the second track frictionally engages the stud portion when the stud portion is received into the trunk portion along the longitudinal axis of the upper body part;

wherein when the lower body part and the upper body part are frictionally attached to each other, the upper body part is rotatable relative to the lower body part about the longitudinal axis of the upper body part.

14. The toy figure assembly of claim 13, wherein a bottom surface of each upper longitudinal flat and bottom surfaces of the interior sidewalls that abut the upper longitudinal flat provide stops for contacting a top surface of the stud portion when received into the trunk portion.

15. The toy figure assembly of claim 13, wherein each interior sidewall that abuts the upper longitudinal flat is visible through the side bore.

16. The toy figure assembly of claim 13, wherein each upper longitudinal flat further extends longitudinally along the inner surface of the neck portion.

17. The toy figure assembly of claim 13, wherein the first track communicates with the through hole and the second track communicates with the first track.

18. The toy figure assembly of claim 13, wherein the interior sidewalls that abut the upper longitudinal flat define bearing surfaces for contacting arm parts to be received into the trunk portion.

* * * * *